United States Patent [19]

Raudat et al.

[11] Patent Number: 4,901,501

[45] Date of Patent: Feb. 20, 1990

[54] CONTINUOUS MOTION CONTAINER PACKER FOR USE WITH TRAYS HAVING POCKETS FOR SUCH CONTAINERS

[75] Inventors: John L. Raudat, North Madison; Steven DaCunha, West Hartford, both of Conn.

[73] Assignee: Standard Knapp, Inc., Portland, Conn.

[21] Appl. No.: 273,212

[22] Filed: Nov. 18, 1988

[51] Int. Cl.[4] ..... B65B 5/10; B65B 21/08; B65B 35/44

[52] U.S. Cl. ..... 53/48; 53/247; 53/251; 53/534; 53/539

[58] Field of Search ..... 53/48, 246, 251, 443, 53/448, 473, 475, 534, 539, 543

[56] References Cited

U.S. PATENT DOCUMENTS

| | | | |
|---|---|---|---|
| 2,978,854 | 4/1961 | Fairest | 53/534 X |
| 3,553,927 | 1/1971 | Anglade Jr. | 53/448 |
| 3,805,476 | 4/1974 | Kawamuba et al. | 53/534 X |
| 4,332,123 | 6/1982 | Calvert | 53/48 X |
| 4,457,121 | 7/1984 | Johnson et al. | 53/247 X |
| 4,494,644 | 1/1985 | Rizzo Sr. | 53/534 X |
| 4,571,923 | 2/1986 | Le Bras | 53/48 X |

*Primary Examiner*—John Sipos
*Assistant Examiner*—Linda B. Johnson
*Attorney, Agent, or Firm*—McCormick, Paulding & Huber

[57] ABSTRACT

Reusable plastic trays of the type adapted to transport large plastic soda bottles generally have cylindrical pockets for receiving the base of the bottle, and these pockets are uniformly spaced with respect to one another in each tray, and also with respect to adjacent bottles in adjacent trays at least when the trays are oriented in end-to-end relationship with respect to one another. This feature is one the present invention takes peculiar advantage of providing for orienting the bottles in two columns, and synchronizing bottle and tray movements so that the bottles can be lowered by their neck rings into the upwardly open pockets of the tray without necessity for periodically interrupting forward movement of the containers and of the trays in an improved continuous motion bottle packer especially suited for use with such reusable plastic trays.

4 Claims, 2 Drawing Sheets

CONTINUOUS MOTION CONTAINER PACKER FOR USE WITH TRAYS HAVING POCKETS FOR SUCH CONTAINERS

BACKGROUND OF THE INVENTION

This invention relates to packing plastic cylindrical containers into trays having generally cylindrical pockets that are adapted to support large plastic containers such as 2 liter soda bottles in spite of a relatively unstable base provided on the plastic container itself. The trays are so defined that the spacing between the pockets for these containers is uniform not only within each particular tray but also within trays located in end-to-end relationship with respect to one another.

Prior art packers for trays of this type generally require that the line of containers be periodically stopped, and for drop packing of an array or slug of containers in accordance with current drop packer technology. The primary aim of the present invention is to provide for continuous motion of both the containers and the trays with the result that the containers are synchronized for movement with the trays in order to allow the containers to be lowered into the tray pockets under controlled conditions and without the usual necessity for dropping the containers.

SUMMARY OF THE INVENTION

In accordance with the present invention an apparatus and method is disclosed for loading cylindrical containers into trays that have cylindrical pockets for receiving the containers, the tray pockets being uniformly spaced from one another not only within a particular tray but also between end-to-end trays. Individual lane conveyors are provided for advancing the containers in discrete columns, preferably two columns, and for spacing the columns apart in order to provide a space for receiving tray conveyor means adapted to feed trays in end-to-end relationship between these lane conveyors. The trays move in the same direction as that of the containers, and a container deadplate is provided downstream of the lane conveyors for supporting these containers as they move by line pressure, in two discrete columns, into a load station located at the downstream end of the container deadplate. A tray deadplate may be provided to permit the trays to be fed in end-to-end relationship by line pressure created by the tray conveyor means. Synchronized means is provided for separated the containers and for feeding both the containers and the trays while maintaining the trays in end-to-end relationship so that the containers are accurately indexed with respect to the pockets defined in the trays as both move through the load station. At the load station means is provided for engaging the necks of the containers so that they can be lowered in a controlled fashion downwardly into the pockets defined for them in the trays.

DETAILED DESCRIPTION

Figure 4:
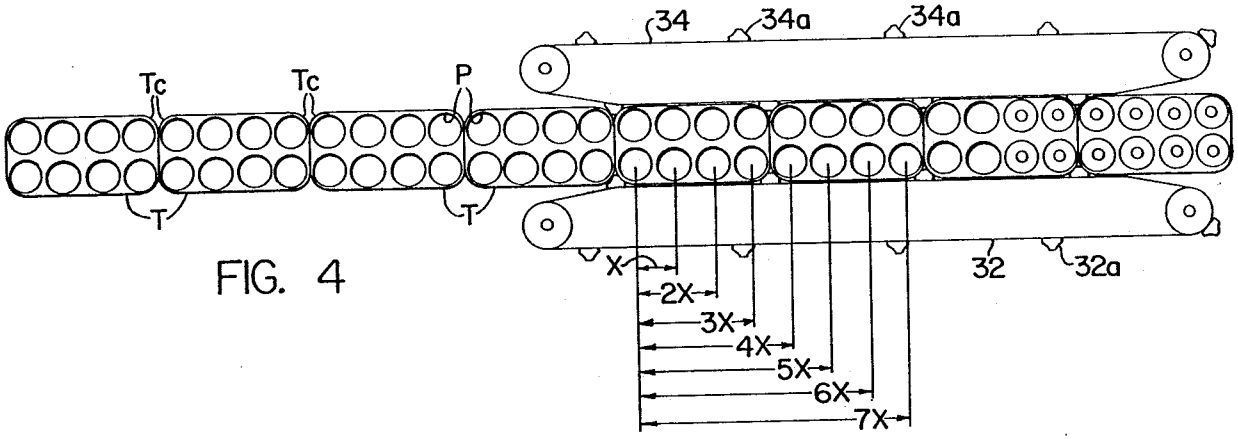
FIG. 4 is a horizontal section taken generally on the line 4—4 of FIG. 2.

Turning now to the drawings in greater detail, FIG. 4 shows the overall configuration for the trays T, T, each tray having a plurality of generally cylindrical pockets as suggested generally at P, P in this view. As shown, each tray T includes eight pockets but it will be apparent that trays might be constructed to define any number of pockets as for example 4, 6, or even 10 or more such pockets. Each tray T has relieved corners Tc, Tc. Each tray also has a feature that renders the present invention especially suitable to handling trays of this general type. That is, each tray T has pockets P, P so arranged adjacent the ends of the tray so that the pitch distance between adjacent pockets (X in FIG. 4) remains constant not only within a particular tray but also remains constant with respect to adjacent end-to-end trays as indicated generally by the dimensional representations 2X, 3X, 4X, 5X, 6X, 7X in FIG. 4.

Figure 2:
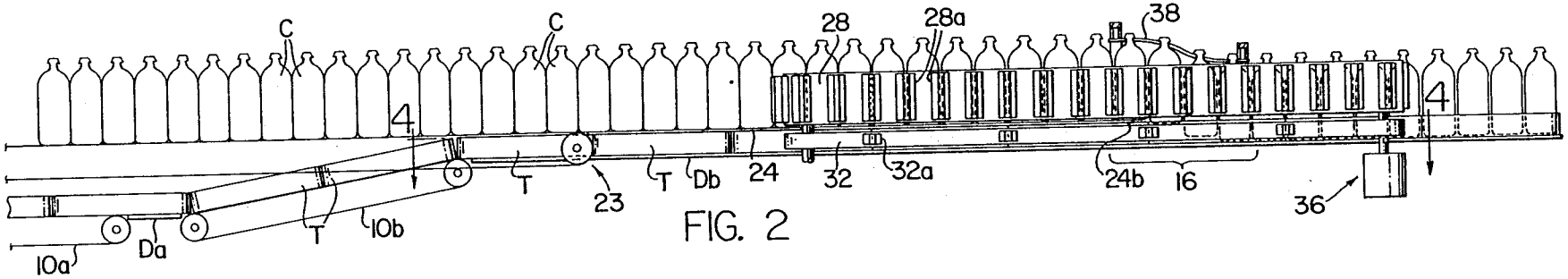
FIG. 2 is a side elevational view of the apparatus illustrated in FIG. 1.

As shown in FIG. 2, the trays T, T are advanced by means of tray conveyor means 10*a*, 10*b* along a path oriented in the same general direction as the path taken by the containers C, C (that is from left to right in the various views presented herein). These trays T, T may move across a deadplate Da between the conveyors 10*a*, 10*b* and it will be apparent that the conveyor 10*b* serves to move the trays upwardly between lane conveyors 12 and 14 so that the trays are ultimately located on an elongated deadplate means Db that supports the trays as they move by line pressure from the tray conveyor means 10*b* directly beneath the path taken by the containers C, C and toward a load station indicated generally at 16 in FIG. 2.

Figure 1:
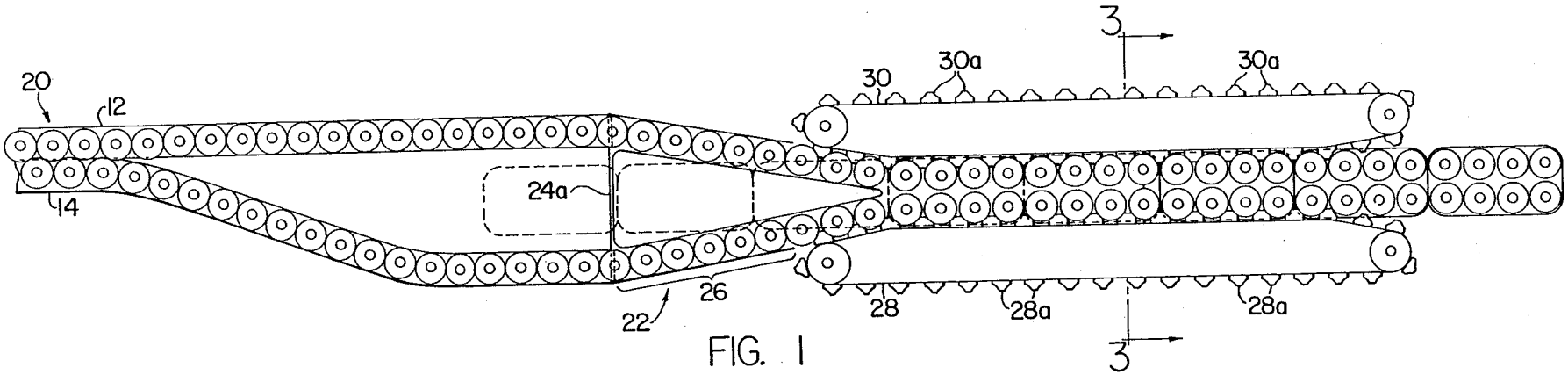
FIG. 1 is a an overall plan view of an apparatus constructed in accordance with the present invention.

The containers C, C, will arrive at the inlet end of the lane conveyors 12 and 14 usually in a nested configuration as suggested generally at 20 in FIG. 1 so that these containers C, C, must be reoriented to provide two discrete columns of containers C, C wherein the containers are provided in side-by-side relationship as suggested generally at 22 in FIG. 1. These lane conveyors 12 and 14 may be generally similar to those described in some detail in a copending patent application entitled "Round Container Orienting System", filed July 6, 1988 under Ser. No. 215,827 and assigned to the assignee herein. This copending application is incorporated by reference herein and discloses and claims a convenient method and apparatus for orienting round cylindrical containers so that they are reoriented from a nested configuration, such as illustrated generally at 20 to a container orientation such as that depicted at 22. This side-by-side relationship or orientation is maintained as the columns converge into the load station as indicated at 16. Basically, this copending application shows and describes lane conveyors that are adapted to shift at least one row of containers laterally relative the other. One lane or column is shifted away from the other so as to accommodate more containers in one lane or column than in the other. This shifting is accomplished in a controlled fashion such that the end-to-end containers in each of the columns arrive at a position where they are laterally aligned with one another for purposes of further handling in a packer such as the packer described herein.

FIG. 2 shows the lane conveyors 12 and 14 terminating at the location indicated generally at 23 where the containers move onto a container deadplate means 24. The upstream end of the container deadplate means 24 is indicated generally 24*a* in FIG. 1 and the downstream end of the container deadplate mean 24 is indicated generally at 24*b* in FIG. 2. It will be apparent that the downstream end 24*b* of the deadplate 24 is located at the container loading station 16.

Means is provided for separating the end-to-end containers in the converging columns indicated generally at 26 in FIG. 1 and said means also provides for moving the containers in a controlled fashion through the load station to provide a spacing between the containers that corresponds to the pocket spacing of the trays referred to previously. In accordance with the present invention said means for separating and for moving the containers in this fashion comprises opposed side belt conveyors 28 and 30. Each side belt conveyor has lugs 28*a* and 30*a* that move inwardly between the adjacent containers in each column in order to space the containers and to move the containers across the container deadplate means 24 mentioned previously.

In further accordance with the present invention means is provided for synchronizing the movement of the trays T, T with movement of the separated containers C, C at least through the load station 16. Preferably, said means for synchronizing tray movement with movement of the separated containers comprises opposed side conveyors 32 and 34 with lugs 32*a* and 34*a* that move inwardly between adjacent trays and more particularly into the relieved corner areas defined by these adjacent trays so as to move the trays T, T downstream and across the tray deadplate means Db without creating any spacing between the trays. Other means might be provided for synchronizing tray movement with that of the containers. For example, with a plastic tray T the bottom surface will have precisely located recesses that are formed to reduce the quantity of plastic material required to form such a tray. In this case the trays can be moved by a conveyor provided below the deadplate Db and having upwardly projecting lugs that move along a slot provided for them in the deadplate Db.

Figure 3:
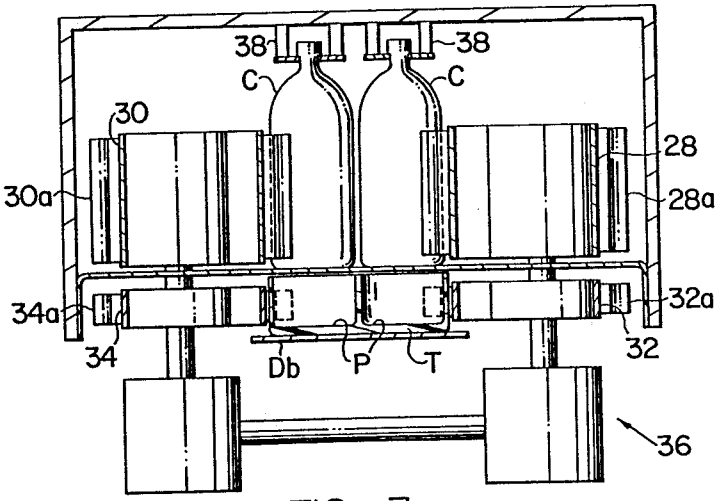
FIG. 3 is a sectional view taken generally on the line 3—3 of FIG. 1.

The means for synchronizing unseparated tray movement with movement of the separated containers further comprises common drive means, indicated generally at 36 in FIG. 3, for both the opposed side belt conveyors having the container engaging lugs 28*a* and 30*a* and for the opposed conveyors 32 and 34 with the lugs 32*a* and 34*a* for engaging the trays. Positive gearing is provided for both said opposed lug conveyors 32 and 34 and for the upper side belt conveyors 28 and 30 associated with the container engaging lugs 28*a* and 30*a*.

Turning next to a more detailed description of the loading station itself, FIGS. 2 and 3 illustrate the containers C as being of the so-called narrow neck variety and further including neck ring flanges that lend themselves to support of the containers from the neck ring flanges. As shown in FIG. 3 a neck ring guide 38 is provided for each of the columns of containers so that the containers are supported as they leave the downstream edge 24*b* of the container deadplate means 24. These neck ring guides 38 are so shaped that the containers C move downwardly into the upwardly open pockets P of the tray T. The side belt conveyors 28 and 30 are of sufficient vertical height, as are the lugs 28*a* and 30*a*, so as to accommodate the cylindrical or round containers C, C while they are lowered into the tray pockets. Once the trays have been so loaded they move away for further packaging or palletization.

We claim:

1. Apparatus for loading cylindrical containers into trays that have cylindrical pockets to receive the containers and the tray pockets being uniformly spaced from one another not only within a particular tray but also between end-to-end trays, said apparatus comprising:

(a) individual lane conveyors for advancing containers in discrete columns and for spacing the columns apart to provide a space therebetween, (b) tray conveyor means for feeding trays end-to-end between said lane conveyors in the same direction as that of the containers, (c) container deadplate means downstream of said lane conveyors and tray deadplate means below said container deadplate means for supporting the trays as the trays move by line pressure beyond said tray conveyor means and into a load station, (d) means for moving the containers across said container deadplate means and into said load station, said container moving means providing a container spacing that corresponds to said tray defined pocket spacing, (e) means for synchronization tray movement with movement of the so separated containers at least through the load station, (f) neck ring guide means engaging the container necks at said load station to support containers as the containers move off a downstream edge of said container deadplate means, said neck ring guides serving to gradually lower the containers into the tray defined pockets as the containers and trays are moved in synchronized relationship with one another.

2. The apparatus of claim 1 wherein said means synchronizing said tray movement with the movement of said separated containers comprises a common drive means for said opposed side belt conveyors and for said opposed conveyors with said lugs for engaging said trays at said relieved corners thereof.

3. A method for packing cylindrical containers in pockets defined trays providing trays in end-to-end relationship such that cylindrical pockets in the trays are provided at a uniform spacing not only between containers in a particular tray but also between containers in adjacent end-to-end trays, said method comprising the steps:

(a) advancing containers in two discrete and individual columns, (b) providing a uniform spacing between the containers as the container columns are moved across a deadplate by driven pushers that engage the containers of each column, (c) moving trays in end-to-end relationship below the deadplate and in timed relationship to containers so moved across the deadplate so that the container and trays move downstream at the same speed, (d) lowering the containers into the pockets of the trays as the containers and trays continue to move downstream.

4. The method of claim 3 wherein said container lowering step is accomplished by neck ring guides engaging container neck ring flanges defined in the containers to support the containers as they move off the deadplate and to gradually lower the containers as these containers continue to be moved downstream by the driven pushers.

* * * * *